United States Patent [19]

Ulrich

[11] Patent Number: 4,714,069

[45] Date of Patent: Dec. 22, 1987

[54] VOLLEYBALL SETTING MACHINE

[76] Inventor: Harold C. Ulrich, Box 282, Blooming Prairie, Minn. 55917

[21] Appl. No.: 871,062

[22] Filed: Jun. 5, 1986

[51] Int. Cl.[4] ..... F41B 7/00

[52] U.S. Cl. ..... 124/26; 124/36; 124/50

[58] Field of Search ..... 124/16, 26, 50, 36, 124/48, 51 R, 7

[56] References Cited

U.S. PATENT DOCUMENTS

| | | | |
|---|---|---|---|
| 1,834,395 | 12/1931 | Gavlak | 124/50 X |
| 1,916,680 | 7/1933 | Miller | 124/36 X |
| 1,927,424 | 9/1933 | Trukenbach et al. | 124/26 |
| 2,815,743 | 12/1957 | Brunderman | 124/7 |
| 3,252,453 | 5/1966 | Giovagnoli | 124/36 X |
| 3,610,223 | 10/1971 | Green | 124/36 X |
| 3,640,262 | 2/1972 | Hunsicker | 124/36 X |
| 3,659,576 | 5/1972 | Eade et al. | 124/36 X |
| 3,779,227 | 12/1973 | Scott | 124/16 |
| 3,867,921 | 2/1975 | Politzer | 124/50 X |
| 3,936,052 | 2/1976 | Hornsby | 124/26 X |

*Primary Examiner*—Randolph A. Reese
*Assistant Examiner*—Peter M. Cuomo
*Attorney, Agent, or Firm*—Kinney & Lange

[57] ABSTRACT

A volleyball setting machine includes a leaf spring powered propulsion assembly mounted on a portable main frame. Several volleyballs are carried in a ball holding rack and are delivered one at a time to be positioned by a ball positioning track up against a discharge chute. The leaf spring is depressed vertically and released to impact on the ball in the chute, and the chute guides it into a desired trajectory.

11 Claims, 9 Drawing Figures

57
26
88
89
57
82
74
42
44
46
24
76
80
78
60
32
30
20
28
72
68
70
54
14
14
16
18
12
10
22
64
28
57
34
36
40

VOLLEYBALL SETTING MACHINE

BACKGROUND OF THE INVENTION

1. Field of the Invention.

This invention has relation to equipment useful for training players on volleyball teams. The machine of the invention can consistently project volleyballs, one after the other, to substantially exactly predetermined positions from predetermined angles and having trajectories of predetermined heights. It is designed for practice drills by volleyball teams, and can assist in increasing the player's ability in spiking high sets, in spiking low sets, in spiking over-the-net bumps by the opposition, and in tipping over long bumps by the player's team.

The known prior art includes only a pipe frame which supports a volleyball in a static position over the net for a player to spike.

2. Description of the Prior Art.

Machines for delivering baseballs or the like to batters for batting practice are well known; but it is believed that these devices make no use of the principle of impacting the ball with a forward end portion of a propulsion arm and subsequently projecting the ball into a trajectory under the guidance of a discharge chute.

The inventor and those in privity with him are aware of no prior art which is closer than that set out above; and are aware of no prior art which negates the patentability of the claims made herein.

SUMMARY OF THE INVENTION

Broadly, the machine of the present invention can be utilized by project any kind of a resilient ball upward into a predetermined trajectory by mechanical impact. This can conclude, without limitation, volleyballs, soccer balls, and even footballs.

Broadly, the machine includes a floor or volleyball court supported main frame; a propulsion assembly mounted on the frame and including a power operated propulsion arm having a ball engaging forward end portion; a ball guide path assembly supported with respect to the main frame and including a ball positioning track which will position any resilient ball landing on it in a preferred aligned relation with respect to the ball engaging forward end portion of the propulsion arm. This guide path assembly also includes a discharge chute. Means are provided for delivering a ball to be projected to the ball positioning track, and the propulsion assembly includes controllable means for initiating powered operation of the propulsion arm to bring its ball engaging end portion into impacting relation to the ball when the ball is in its preferred aligned relation so that the ball leaves the machine in such a manner that the discharge chute affects the trajectory of the ball after it has been impacted.

In the particular form of the invention as shown, the propulsion assembly includes an elongated leaf spring mounted to a rearward end portion of a support base to position an unsupported free forward ball engaging portion of the leaf spring adjacent a forward end portion of the support base. The propulsion drive means is motor driven to initially depress the free end of the leaf spring in direction away from a ball to be projected when the ball is in the preferred aligned relationship with respect to the end of the leaf spring, and the propulsion drive means is adapted to finally release the free end of the leaf spring to cause it to impact the ball to project the ball outwardly under the guidance of the discharge chute.

In the invention as shown, the ball holding assembly is positioned on the main frame, and a ball feed assembly releases one ball at a time from the holding assembly to take position on the ball positioning track after the preceding ball has been projected from the machine.

DETAILED DESCRIPTION OF THE PREFERRED EMBODIMENTS

Figure 1:
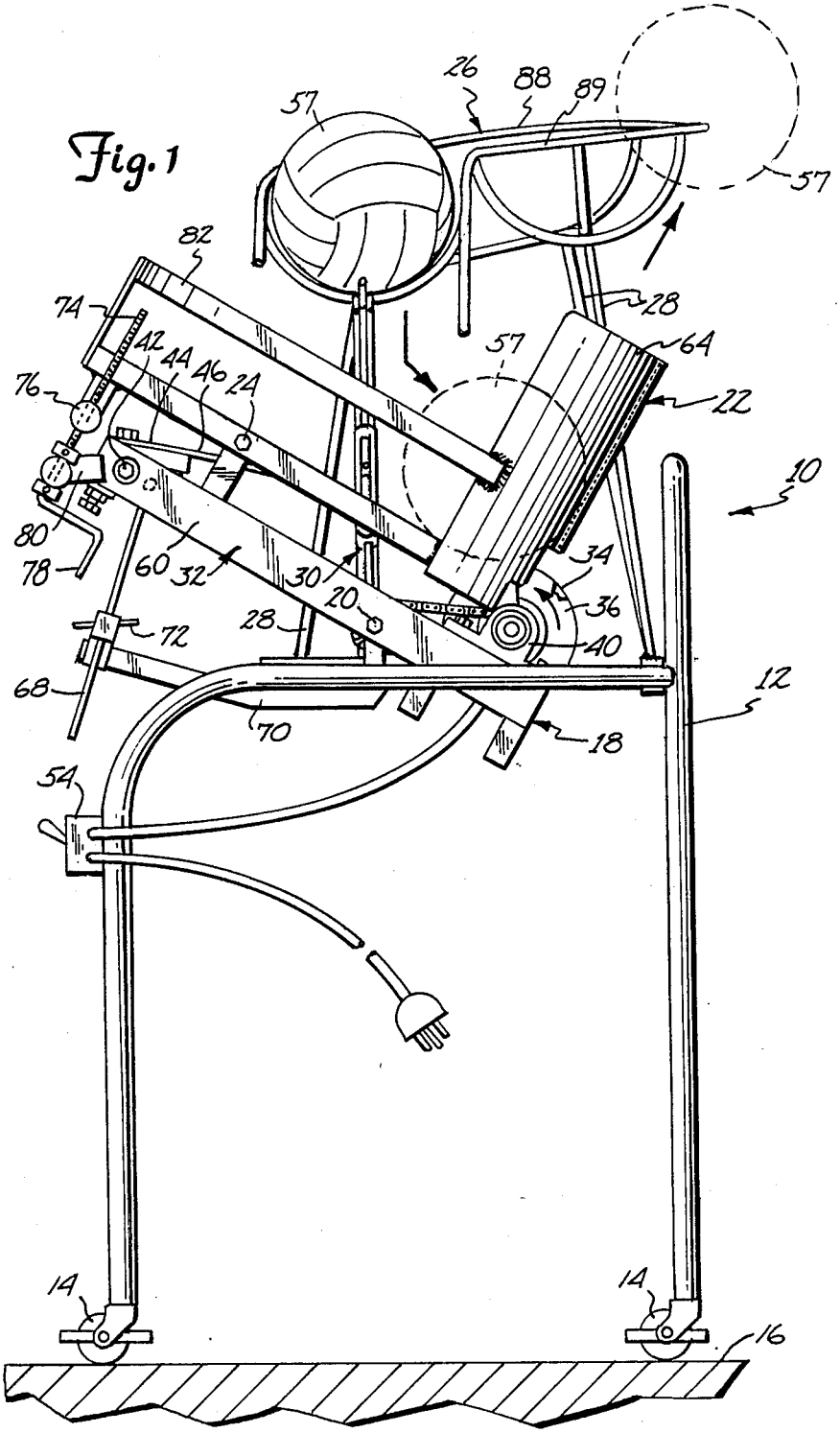
FIG. 1 is a side elevational view of a volleyball setting machine made according to the present invention.

A volleyball setting machine 10 includes a main frame 12 supported by four caster wheels 14 on a floor or volleyball court 16.

The main frame 12 supports a propulsion assembly 18 which is pivotably mounted to the main frame as at 20; a ball guide path assembly 22 which is pivotably mounted to the propulsion assembly 18 as at 24; and a ball holding assembly 26 which is supported directly on the main frame by a plurality of ball holding assembly support legs 28. A ball feed assembly 30 is also fixedly positioned with respect to the main frame 12.

Preferably at least two of the four caster wheels 14 are manually lockable and unlockable so that the coach or machine operator can easily move the machine to obtain the delivery of the projected ball to just exactly the desired location and then the positioning of the machine can be maintained by locking the caster wheels until such time as a new positioning is desired.

Figure 6:
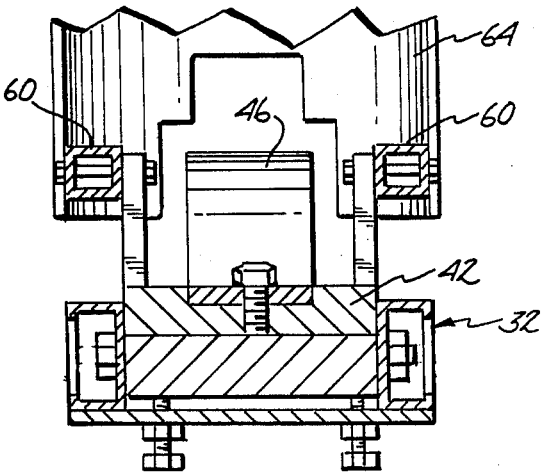
FIG. 6 is a fragmentary sectional view taken on the line 6—6 in FIG. 4.
Figure 5:
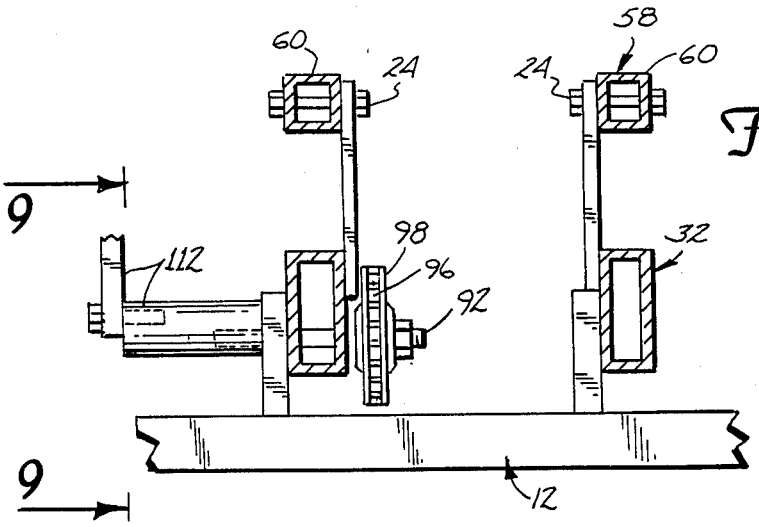
FIG. 5 is a fragmentary vertical sectional view taken on the line 5—5 in FIG. 4.
Figure 4:
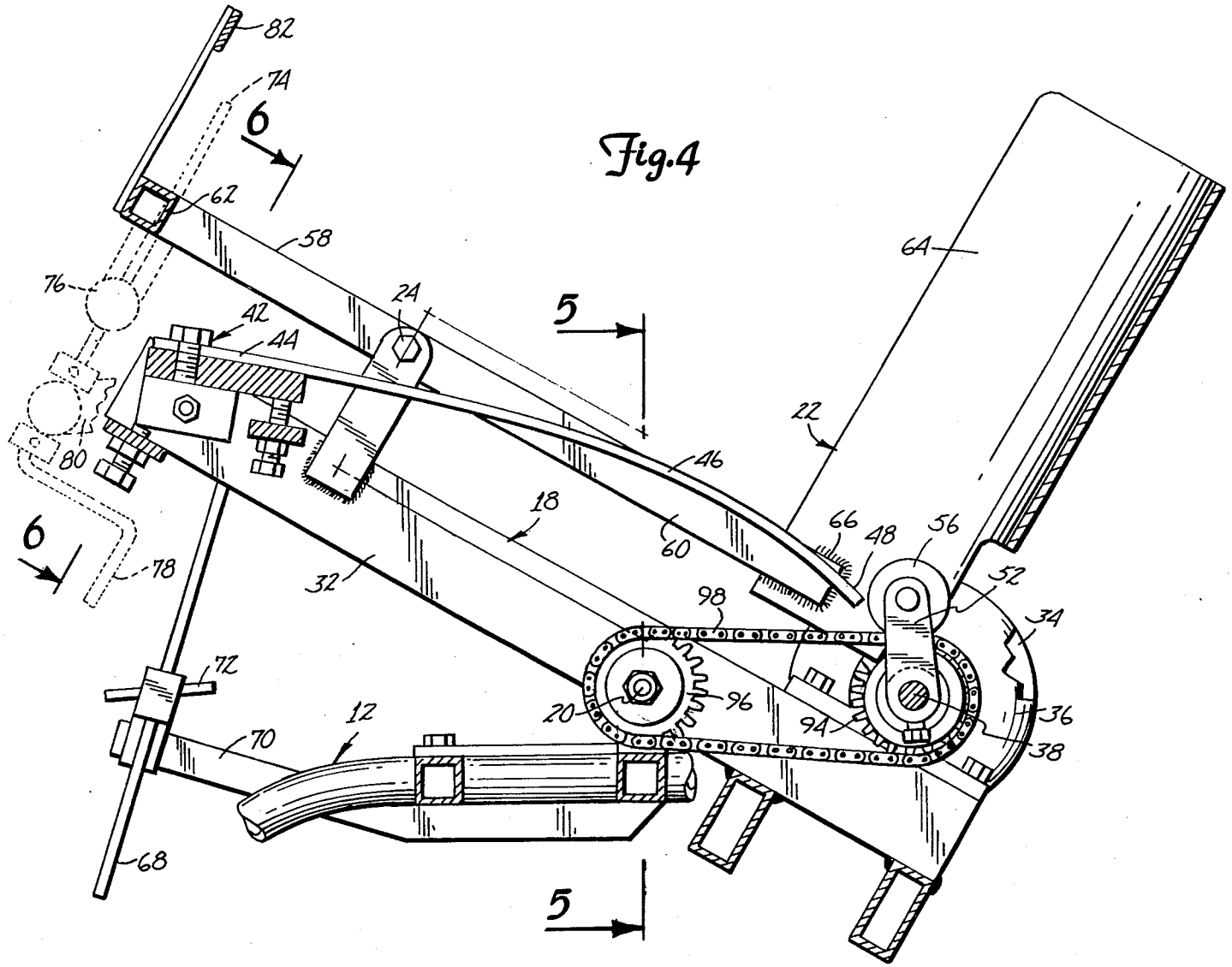
FIG. 4 is an enlarged vertical sectional view taken on the line 4—4 in FIG. 2.

The propulsion assembly 18 includes an elongated leaf spring and motor support base 32 which is pivotably mounted to the main frame as at 20; an electric motor 34 and associated reduction gear 36; as well as a drive propulsion drive shaft 38 which is journaled in pillow block bearing, 40 mounted on the support base 32. As clearly seen in FIG. 1, the motor and propulsion drive shaft are mounted on a portion of the support base 32 forwardly of pivot point 20. Mounted at a rear end portion of the support base 32 as at 42 is a rear end portion 44 of an elongated leaf spring 46. As perhaps best seen in FIGS. 4 and 6, appropriate set screw adjustments are provided to precisely set and maintain the position of the leaf spring. Also as best seen in FIG. 4, the leaf spring 46 is provided with a forward ball-engaging end portion 48.

Also as a part of the propulsion assembly 18 is a cam arm 52 extending outwardly from and rotating with propulsion drive shaft 38. The speed of the motor 34 and the ratio of gear reduction are such that the cam arm will make one complete revolution at the minimum time spacing desired between the projection of successive volleyballs. A minimum frequency between delivery of balls into the air of between four and five seconds has been found to be quite satisfactory. A motor ON-OFF switch 54 is provided on the main frame 12 to give a coach or machine operator control over the timing of the delivery of balls from the machine. This switch may also be hand held.

Figure 2:
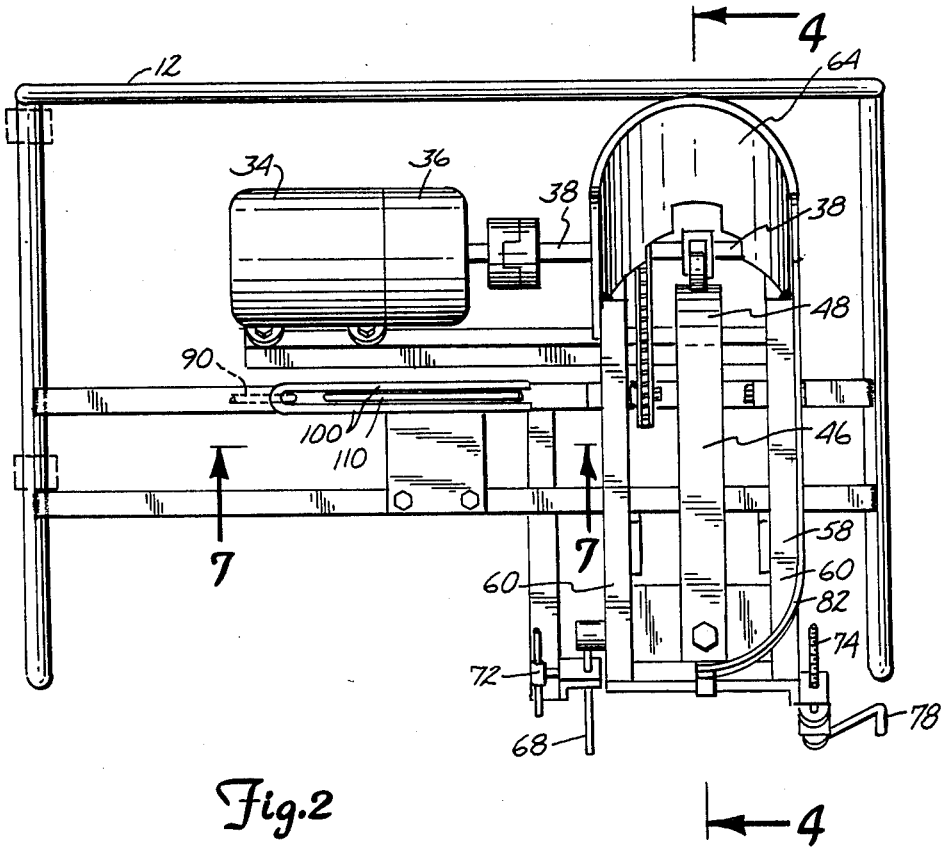
FIG. 2 is a top plan view of the volleyball setting machine made of FIG. 1 with a ball holding assembly removed therefrom for clarity of illustration.
Figure 9:
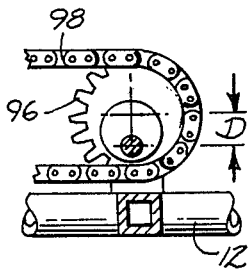
FIG. 9 is a fragmentary vertical sectional view taken on the line 9—9 in FIG. 5.
Figure 3:
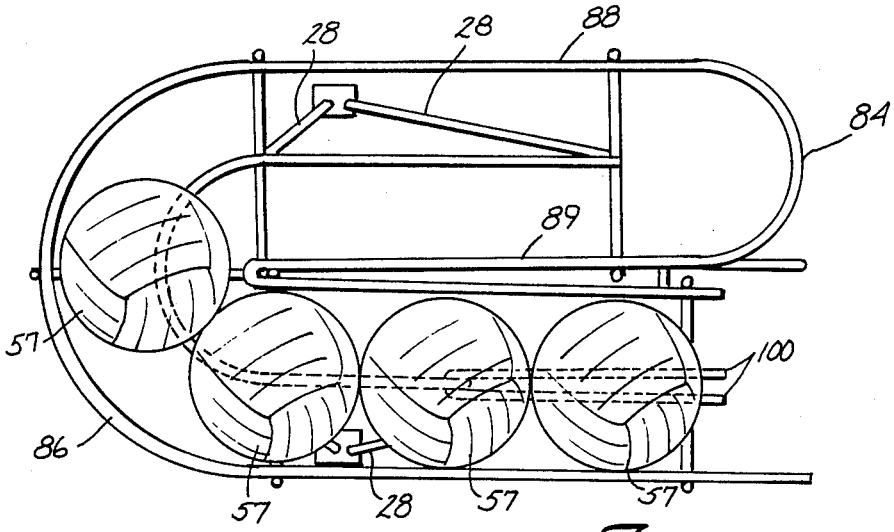
FIG. 3 is a top plan view of the ball holding assembly which has been omitted from FIG. 2 and shown in the same relative position.

Rotatably mounted on an outer end of cam arm 52 is a roller bearing or other anti-friction bearing 56. As perhaps best seen in FIGS. 2 and 4, this roller bearing is in longitudinal alignment with the forward ball-engaging portion 48 of the leaf spring 46, and as the cam arm and roller bearing rotate in counterclockwise direction as seen in FIG. 4, the roller bearing will contact the forward portion 48 of the leaf spring and will continually depress it until such time as the roller bearing moves clear of the spring 46 and allows it to rebound in upward direction to engage one of the volleyballs 57 in a manner to be described.

The ball guide path assembly 22 includes a U-shape ball positioning track 58 made up of a pair of mutually parallel, spaced-apart, ball-engaging rails 60,60 and a connecting rail 62 integral with both of the ball engaging rails 60 at their rearward ends. A volleyball discharge chute 64 is U-shape in cross section and is rounded to have a part-cylindrical dimension which is only sufficiently larger than the diameter of a volleyball such that a volleyball projected along the discharge chute will be accurately guided by the chute and not impeded by it. As best seen in FIG. 4, the chute can be welded as at 66 to each of the forward ends of the ball engaging rails 60,60.

As perhaps best seen in FIG. 4, a first positioning rod 68 is pinned to the support base 32 as at 69 and extends through a provided opening in a first positioning rod support bracket 70 which extends integrally from the main frame 12. A T-shape set screw 72 is threadably mounted in the bracket 70 in position to impinge on first positioning rod 68. See FIG. 2. By loosening set screw 72, and raising or lowering first positioning rod 68, the angle of the ball positioning track 58 and the discharge chute 64, along with the propulsion assembly 18, can be changed to change the angle at which volleyballs will be discharged from the machine.

Movement of the ball guide path assembly 22 with respect to the propulsion assembly 18 about the pivotal connection at 24 only incidentally makes minor changes in the angular alignment of the discharge chute which can be compensated for by changing the positioning of the first positioning rod 18 in the bracket 70. The purpose of pivoting the guide path assembly with respect to the propulsion assembly is to obtain a higher or a lower trajectory on the balls when they are discharged. For this purpose, a threaded second positioning rod 74 is threadably mounted in a second positioning rod first support bracket 76 which extends integrally downwardly and outwardly from one of the ball engaging rails 60 of the ball positioning track 58. The second positioning rod 74 is provided with an integral crank 78 at its lower end, and this end of the second positioning rod 74 is fixed by appropriate collars against vertical movement with respect to a second positioning rod second support bracket 80 which extends integrally outwardly from a rear portion of the motor support base 32. See FIG. 1. Using the crank 78 to move the rearward portion of the ball positioning track 58 away from the support base, moves the forward ends of the ball engaging rails 60,60 closer to the support base 32, and, consequently, closer to the ball engaging portion 48 of the leaf spring 46. This results in more energy being imparted by the leaf spring to a ball resting on the forward ends of the rails 60,60 and on the lower end of the volleyball discharge chute 64 when the spring is released from bearing 56; and results in the ball, when projected, having a relatively higher trajectory. Rotation of the crank 78 in the opposite direction to bring the rearward portion of the ball positioning track 58 closer to the support base 32 results in the forward ends of the ball positioning tracks being situated farther from the support base 32. This results in less energy being imparted by the released leaf spring and results in a relatively lower trajectory of the ball.

As perhaps best seen in FIG. 1, a railing 82 extends from one side of the discharge chute 64, in parallel relation over one of the ball engaging rails 60 to end in position over the connecting rail 62 in position to insure that volleyballs leaving the ball holding assembly 26 take position on the ball positioning track 58 and do not roll off of the machine.

The ball holding assembly 26 includes a ball holding rack 84 which provides a ball support conduit 86 which terminates in a position to discharge each ball to be projected onto the ball positioning track 58 where it will come to rest in contact with each of the ball engaging rails 60,60 and with the lowermost portion of the discharge chute 64. This conduit 86 could be a smooth sheet metal or plastic chute having a U-shape form of substantially the same diameter as that of the volleyballs; but in the form of the invention as shown, rack conduit 86 is defined by mutually parallel side rods 88 and 89 and a bottom center rod 90, parallel with rods 88 and 89.

The ball feed assembly 30 includes a ball feed drive shaft 92 rotatably mounted on the main frame 12 in concentric relation to the pivot point 20 of the propulsion assembly leaf spring and motor support base 32 with respect to the main frame 12. A ball feed assembly drive sprocket 94 is concentric with and rotates with the propulsion drive shaft 38, a ball feed assembly driven sprocket 96 on the ball feed drive shaft 92 is operably connected to sprocket 94 by a ball feed assembly drive chain 98, and in the form of the invention as shown, this causes the ball feed drive shaft 92 to rotate at the same angular speed as the propulsion drive shaft 38.

Figure 8:
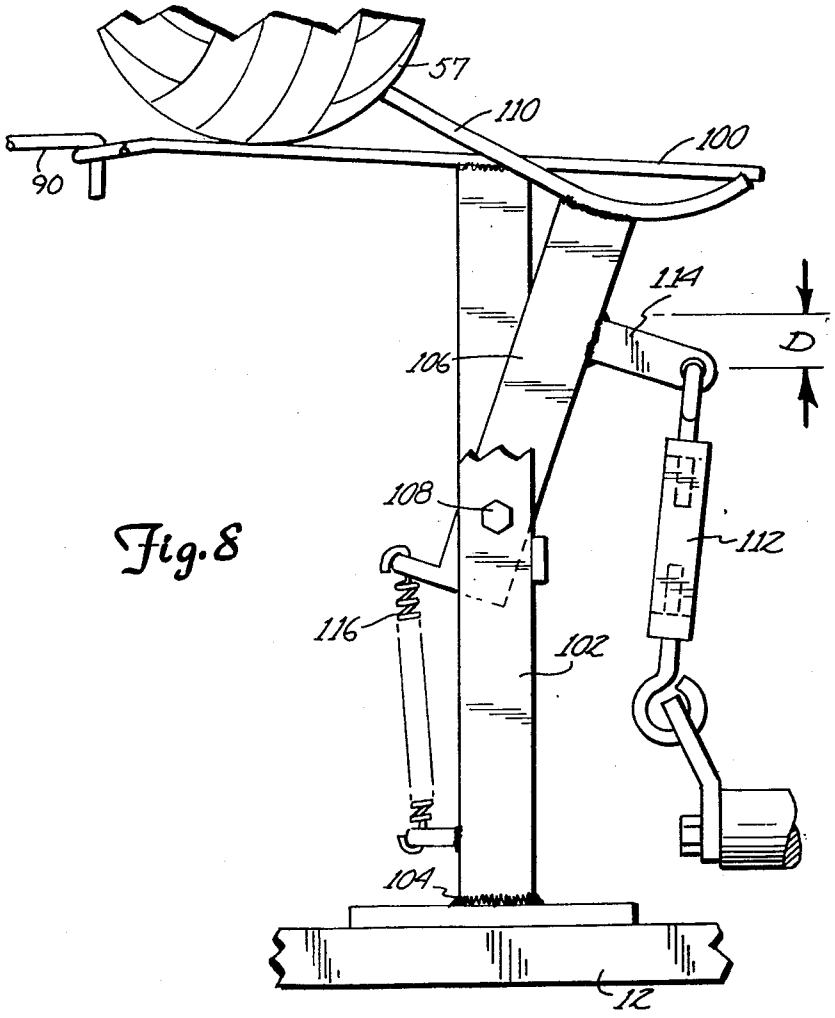
FIG. 8 is a view similar to FIG. 7 but showing a different positioning of the ball escapement mechanism.
Figure 7:
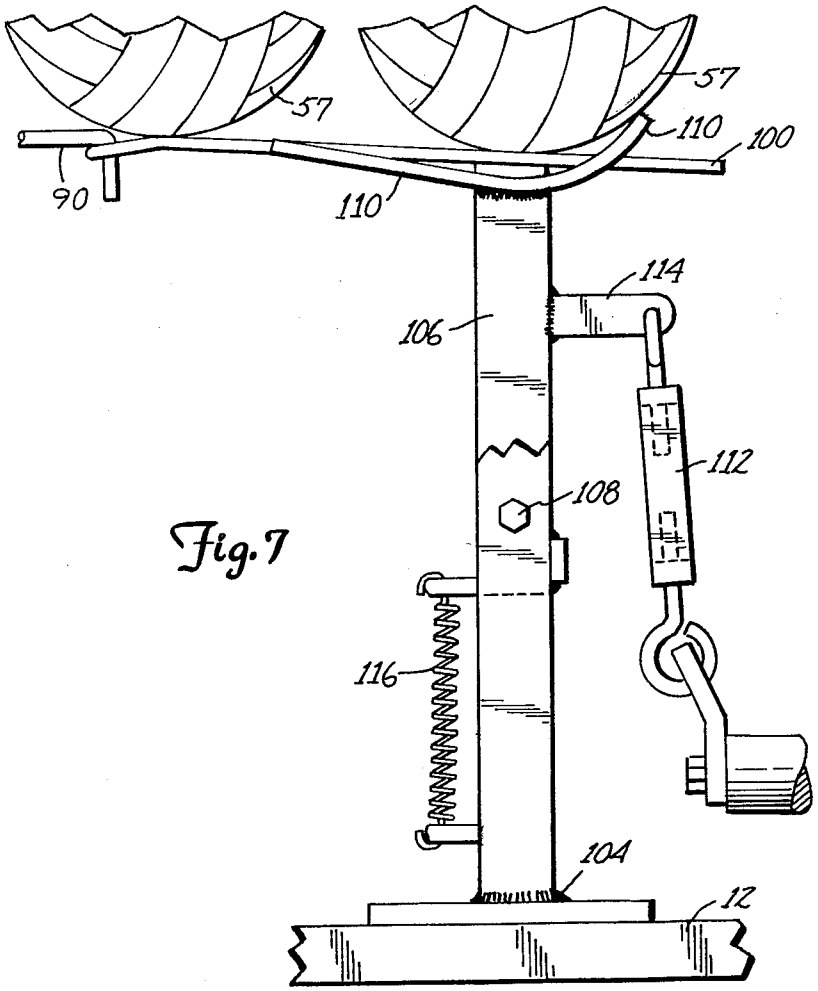
FIG. 7 is an enlarged fragmentary elevational view taken on the line 7—7 in FIG. 2 with parts omitted and parts broken away and showing a ball escapement mechanism.

A U-shape rod 100 is supported in fixed relation to the main frame 12 by a bifurcated stanchion 102 which is integrally mounted as at 104 to the main frame, and is welded at its top bifurcated ends separately to each of parallel, spaced-apart legs of the U-shape rod 100. As best seen in FIGS. 7 and 8, the bottom center rod 90 which partially defines the rack conduit 86 turns downwardly at its outermost end, and fits through the opening at the connection of the arms of the U-shape rod to constitute this U-shape rod as an integral linear extension of bottom center rod 90.

As best seen in FIGS. 7 and 8, a ball escapement arm 106 is pivotably mounted at its lower end portion between parallel bifurcated portions of the stanchion 102 as at 108. A curved ball escapement rod 110 is welded to the top of escapement arm 106.

As best seen in FIGS. 5, 7, 8 and 9, a ball feed assembly escapement link 112 is rotatably mounted at a lower end thereof with respect to ball feed drive shaft 92 about a crank axis parallel to but offset from the support base/ball feed drive axis. In this manner, the lower end of the link 112 is displaced by a vertical distance "D" each time the drive shafts 92 and 38 make one complete revolution (see FIG. 9), and this imparts a similar vertical movement "D" to an upper end portion of the link 112 (see FIG. 8).

The upper end of escapement link 112 is connected to the ball escapement arm 106 as at 114, and this causes escapement arm 106 and integrally attached curved escapement rod 110 to move between a first ball retaining position (as seen in FIG. 7) wherein a forward portion of the escapement rod prevents a first ball from discharging into the ball positioning track 58 and a second ball release position (as seen in FIG. 8) wherein the forward portion of the escapement rod moves clear of the first ball and the U-shape rod 100 to allow that ball to discharge into the ball positioning track while a rearward portion of the escapement rod prevents a second ball from movement to position over the escapement rod.

A tension coil spring 116 constantly biases the escapement arm and ball escapement rod to tend to move from said second ball release position toward said first ball retaining position.

Although the present invention has been described with reference to preferred embodiments, workers skilled in the art will recognize that changes may be made in form and detail without departing from the spirit and scope of the invention.

What is claimed is:

1. A machine for projecting resilient balls upward into predetermined trajectories by mechanical impact, said machine including:

(a) a floor supported main frame;

(b) a propulsion assembly mounted to the main frame and including a power operated propulsion arm having a ball engaging forward end portion;

(c) a ball guide path assembly supported with respect to the main frame and including a ball positioning track adapted to position a ball-to-be-projected in a preferred aligned relation with respect to said forward end portion of the propulsion arm and including a discharge chute adapted to affect the trajectory of the ball after it has been projected by the propulsion arm;

(d) means for delivering a ball to be projected to said ball positioning track;

(e) said propulsion assembly including controllable means for initiating operation of the propulsion arm when the ball-to-be-projected is in said preferred aligned relation;

(f) wherein the propulsion assembly is adjustably mounted with respect to the main frame and the ball guide path assembly is mounted on the propulsion assembly; and (g) adjustable propulsion assembly positioning means is provided between the propulsion assembly and the main frame to selectively vary the angular relation of the propulsion assembly to the main frame, thus to vary the angular relation of the guide path assembly to the floor.

2. The machine of claim 1 wherein:

H. adjustable means is provided between the ball guide path assembly and the propulsion assembly to vary the positioning of the ball-to-be projected between a preferred aligned relation closer to the forward ball engaging portion of the propulsion arm for achieving a relatively higher ball trajectory and a preferred aligned relation farther from that end of the propulsion arm for achieving a relatively lower ball trajectory.

3. A volleyball setting machine for projecting resilient balls upward into predetermined trajectories, said machine including:

(a) a court supported, movable, main frame;

(b) a propulsion assembly mounted to the main frame and including a propulsion arm having a ball engaging forward end portion;

(c) a ball guide path assembly supported with respect to the main frame and including a ball positioning track adapted to position a ball-to-be-projected in a preferred aligned relation with respect to said forward end portion of the propulsion arm and including a discharge chute adapted to guide the ball after it has been projected by the propulsion arm;

(d) a ball holding assembly mounted with respect to the main frame to position at least one ball above the ball positioning track;

(e) said propulsion assembly including means for initiating operation of the propulsion arm after a ball is in said preferred aligned relation;

(f) means for delivering a ball from said holding assembly to the ball positioning track after a ball has been projected from the guide path assembly; and (g) wherein the propulsion assembly includes:

(1) an elongated support base mounted to the main frame, (2) a motor mounted to a first forward end portion of the support base, (3) an elongated leaf spring mounted at its rear end portion to a second rearward end portion of the support base to position an unsupported free forward ball engaging portion adjacent the first forward end portion of the support base, (4) propulsion drive means driven by said motor adapted to initially depress the free end of the leaf spring in direction away from a ball-to-be-projected when in said preferred alignment and adapted to finally release said free end to impact said ball, and (5) manually operable control means adapted selectively to enable and to disable the propulsion drive means.

4. The machine of claim 3 wherein:

H. the ball guide path assembly is mounted on the elongated support base;

I. the support base is pivotably mounted to the main frame on a transverse support base axis between the forward and rearward end portions of the support base; and J. adjustable support base holding means is provided between the base and the main frame to selectively vary the angular relation of the support base to the main frame, thus to vary the angular relation of the discharge chute to the court.

5. The machine of claim 4, wherein:

K. the ball positioning track is elongated and includes first and second mutually parallel ball-engaging rails;

L. the ball guide path assembly is pivotably mounted with respect to the propulsion assembly on a ball guide assembly axis parallel to the support base axis; and M. adjustable ball positioning track holding means is provided between the guide path assembly and the propulsion assembly to selectively vary the positioning of the ball-to-be-projected between a preferred aligned relation closer to the forward end portion of the propulsion arm for achieving a relatively higher ball trajectory and a preferred aligned relation farther from that end of the propulsion arm for achieving a relatively lower ball trajectory.

6. The machine of claim 5, wherein:

N. the propulsion drive means includes:

(1) a propulsion drive shaft driven by the motor to make one revolution for each ball to be projected, said shaft being rotatably supported on, and at the forward end portion of, the support base on an axis transverse to the longitudinal axis of the leaf spring, (2) a cam arm integral with the propulsion drive shaft and extending outwardly therefrom, (3) a roller bearing rotatably mounted to an outer end portion of the cam arm in position to successively contact the forward end of the leaf spring to depress it and move clear of it causing the sudden release of the leaf spring each time the propulsion drive shaft makes a complete revolution.

7. The machine of claim 3, wherein:

G. the ball holding assembly including a rack mounted to the main frame and providing a ball support conduit terminating in position to discharge a ball-to-be-projected from the conduit onto the ball positioning track of the guide path assembly.

8. The machine of claim 7, wherein:

H. the conduit provided by the rack is of sufficient length to accommodate a plurality of balls-to-be-projected and lies at an angle such that all such balls can feed successively to the discharge point.

9. The machine of claim 3, wherein:

H. the propulsion drive means includes:

(1) a propulsion drive shaft driven by the motor to make one revolution for each ball to be projected, said shaft being rotatably supported on, and at the forward end portion of the support base on an axis transverse to the longitudinal axis of the leaf spring, (2) a cam arm integral with the propulsion drive shaft and extending outwardly therefrom;

(3) a cam lobe attached to an outer end portion of the cam arm in position to successively contact the forward end of the leaf spring, to depress it and to move clear of it causing the sudden release of the leaf spring once each time the propulsion drive shaft makes a complete revolution.

10. The machine of claim 9, wherein:

I. said cam lobe is constituted as an anti-friction bearing rotatably mounted to the outer end portion of the cam arm.

11. The machine of claim 10, wherein:

J. the ball holding assembly includes a rack mounted on the main frame and providing a ball support conduit terminating in position to discharge a ball-to-be-projected from the conduit onto the ball positioning track of the guide path assembly;

K. the conduit provided by the rack is of sufficient length to accommodate a plurality of balls-to-be-projected and lies at an angle such that all such balls can feed successively to said discharge point;

L. the rack conduit is defined by mutually parallel, first and second side rods and a bottom center rod;

M. the ball feed assembly delivery means is mounted to the main frame and includes:

(1) a U-shape linear extension of the rack conduit bottom center rod fastened with respect to that rod at the conduit ball discharge position, (2) a bifurcated stanchion integral with the main frame and the U-shape linear center rod extension to support the rod extension in fixed relation to the main frame, (3) a ball feed assembly drive means including:

(a) a ball feed assembly drive shaft rotatably mounted on the main frame in concentric relation to the support base axis, (b) a ball feed assembly drive sprocket concentric with and rotatable with the propulsion drive shaft, (c) a ball feed assembly drive sprocket concentric with and integral with the ball feed assembly drive shaft, (d) a drive train between said sprockets, (e) a ball feed assembly escapement link rotatably mounted at a lower end thereof with respect to the ball feed assembly drive shaft about an escapement axis parallel to and offset from the support base and ball feed assembly drive axes, (f) a ball escapement arm pivotably mounted at its lower end portion between parallel, bifurcated portions of the stanchion, (g) a curved ball escapement rod integral with an upper end of the escapement arm, and extending between the legs of the U-shape extension of the bottom center rod, (h) said ball escapement rod being movable with each full rotation of said propulsion drive shaft between a first ball retaining position wherein a forward portion of the ball escapement rod prevents a first ball from discharging into the ball positioning track and a second ball release position wherein the forward portion of the ball escapement rod moves clear of the first ball to allow it to discharge into the ball positioning track and a rearward portion of the escapement rod prevents a second ball from movement to position over the escapement rod.

* * * * *

UNITED STATES PATENT AND TRADEMARK OFFICE

CERTIFICATE OF CORRECTION

PATENT NO. : 4,714,069

DATED : December 22, 1987

INVENTOR(S) : Harold C. Ulrich

It is certified that error appears in the above-identified patent and that said Letters Patent is hereby corrected as shown below:

Column 6, line 2, delete "H." and insert --(h)--.

Column 6, line 54, delete "H." and insert --(h)--.

Column 6, line 56, delete "I." and insert --(i)--.

Column 6, line 60, delete "J." and insert --(j)--.

Column 6, line 66, delete "K." and insert --(k)--.

Column 7, line 1, delete "L." and insert --(l)--.

Column 7, line 5, delete "M." and insert --(m)--.

Column 7, line 15, delete "N." and insert --(n)--.

Column 7, line 32, delete "G." and insert --(h)--.

Column 7, line 39, delete "H." and insert --(i)--.

Column 7, line 44, delete "H." and insert --(h)--.

Signed and Sealed this

Twenty-fourth Day of May, 1988

*Attest:*

*Attesting Officer*

DONALD J. QUIGG

*Commissioner of Patents and Trademarks*